US009226587B2

(12) United States Patent
Halimi et al.

(10) Patent No.: US 9,226,587 B2
(45) Date of Patent: Jan. 5, 2016

(54) PORTABLE PERSONAL SUPPORT

(76) Inventors: Henry M. Halimi, Los Angeles, CA (US); Mark Nourmand, Beverly Hills, CA (US)

( * ) Notice: Subject to any disclaimer, the term of this patent is extended or adjusted under 35 U.S.C. 154(b) by 428 days.

(21) Appl. No.: 13/417,292

(22) Filed: Mar. 11, 2012

(65) Prior Publication Data

US 2013/0232696 A1 Sep. 12, 2013

(51) Int. Cl.

| | |
|---|---|
| ***A47C 20/00*** | (2006.01) |
| ***A47C 16/00*** | (2006.01) |
| ***A47G 9/10*** | (2006.01) |

(52) U.S. Cl.

CPC ..... *A47C 16/00* (2013.01); *A47G 9/1009* (2013.01); *A47G 9/1054* (2013.01)

(58) Field of Classification Search

CPC ..... A47G 9/10; A47G 9/1009; A47G 9/1054; A47C 7/383

USPC ..... 5/622, 636, 637, 638, 640, 657

See application file for complete search history.

(56) References Cited

U.S. PATENT DOCUMENTS

| | | | | | |
|---|---|---|---|---|---|
| 1,515,886 | A | * | 11/1924 | Rumsey | 27/13 |
| 4,087,069 | A | * | 5/1978 | Hall et al. | 248/573 |
| 4,122,587 | A | * | 10/1978 | Weiss et al. | 5/621 |
| 4,235,472 | A | | 11/1980 | Sparks et al. | |
| 4,504,050 | A | | 3/1985 | Osborne | |
| 4,527,555 | A | * | 7/1985 | Ruf | 602/39 |
| 4,995,067 | A | * | 2/1991 | Royster et al. | 378/177 |
| 5,165,137 | A | | 11/1992 | Amrein et al. | |
| 5,177,823 | A | * | 1/1993 | Riach | 5/636 |
| 5,303,890 | A | * | 4/1994 | Carruth | 248/118 |
| 6,065,808 | A | * | 5/2000 | Tinsley | 297/423.11 |
| 6,081,947 | A | | 7/2000 | Disher | |
| 6,151,734 | A | | 11/2000 | Lawrie | |
| 6,270,160 | B1 | | 8/2001 | Blake | |
| 6,378,445 | B1 | * | 4/2002 | Willard et al. | 108/115 |

(Continued)

FOREIGN PATENT DOCUMENTS

EP 1096911 B1 9/2003

OTHER PUBLICATIONS

OAKWORKS, Inc.; Vitrectomy Recovery Face Support; This document was was retrieved on May 31, 2011 from fhttp://www.mavitrectomie.com/pdf/face_support_inst.pdf.

(Continued)

*Primary Examiner* — David E Sosnowski

(74) *Attorney, Agent, or Firm* — Martino Patent Law at the Law Offices of Sepehr Daghighian

(57) ABSTRACT

A portable personal support includes a u-shaped base support having a proximal end and a distal end, an intermediate support has a bottom end and a top end, where the intermediate support is pivotably adjustable and lockable relative to the base support. A u-shaped head support has a chin end and a forehead end, where the head support is pivotably adjustable and lockable relative to the intermediate support. A u-shaped headrest is removably attachable to the head support. In a stored configuration the head support is disposed within the intermediate support and the intermediate support is disposed within the base support where the base support, intermediate support and head support all reside in substantially the same plane. In a deployed configuration the base support and head support are generally horizontally positioned and the intermediate support is generally vertically positioned.

15 Claims, 7 Drawing Sheets

(56) References Cited

U.S. PATENT DOCUMENTS

| | | | | |
|---|---|---|---|---|
| 6,397,414 | B1 | 6/2002 | Lloyd | |
| 6,427,273 | B1 | 8/2002 | Berke et al. | |
| 6,499,158 | B1 * | 12/2002 | Easterling | 5/600 |
| 6,619,733 | B2 | 9/2003 | Pearson | |
| 6,663,055 | B2 * | 12/2003 | Boucher et al. | 248/118 |
| 6,684,431 | B2 | 2/2004 | Splane, Jr. | |
| 6,718,581 | B2 * | 4/2004 | Riach | 5/632 |
| 6,718,582 | B1 * | 4/2004 | Tinsley | 5/640 |
| 6,721,978 | B1 | 4/2004 | Tankersley | |
| 6,758,447 | B2 * | 7/2004 | Tinsley | 248/118 |
| 6,857,149 | B2 * | 2/2005 | Hoggatt et al. | 5/632 |
| 7,020,918 | B1 * | 4/2006 | Tinsley | 5/632 |
| 7,036,168 | B1 | 5/2006 | Knickerbocker | |
| 7,080,420 | B2 * | 7/2006 | Damron | 5/640 |
| 7,089,613 | B2 * | 8/2006 | Cohen | 5/622 |
| 7,350,250 | B2 * | 4/2008 | Froelich | 5/637 |
| 7,380,299 | B1 * | 6/2008 | DeMayo | 5/648 |
| 7,424,759 | B2 * | 9/2008 | Damron | 5/641 |
| 7,441,292 | B2 * | 10/2008 | Williams et al. | 5/636 |
| 7,552,733 | B1 | 6/2009 | Schubert, III | |
| 7,581,266 | B2 * | 9/2009 | Krecow et al. | 5/624 |
| 7,640,609 | B2 * | 1/2010 | Roleder et al. | 5/622 |
| 7,673,836 | B2 | 3/2010 | Wallock et al. | |
| 7,730,563 | B1 * | 6/2010 | Sklar et al. | 5/637 |
| 7,748,064 | B2 | 7/2010 | Hamilton | |
| 7,761,943 | B2 * | 7/2010 | Roleder et al. | 5/622 |
| 7,979,933 | B2 * | 7/2011 | Roleder et al. | 5/622 |
| 7,979,934 | B2 * | 7/2011 | Roleder et al. | 5/622 |
| 8,370,976 | B2 * | 2/2013 | Matt et al. | 5/640 |
| 8,495,775 | B2 * | 7/2013 | Fair et al. | 5/655 |
| 8,584,283 | B2 * | 11/2013 | Mabry | 5/632 |
| 8,590,078 | B1 * | 11/2013 | Zenoff | 5/655 |
| 2002/0050009 | A1 * | 5/2002 | Ley | 5/657 |
| 2003/0172462 | A1 | 9/2003 | Hoggatt et al. | |
| 2004/0123389 | A1 * | 7/2004 | Boucher et al. | 5/623 |
| 2004/0262865 | A1 | 12/2004 | Sigler | |
| 2009/0302659 | A1 | 12/2009 | Goddu | |
| 2014/0033439 | A1 * | 2/2014 | Berhanu | 5/640 |

OTHER PUBLICATIONS

Comfort Cure, Inc.; Table Top/Sleep Support System; This page was retrieved on May 31, 2011 from http://www.comfortcure/products.html.

* cited by examiner

PORTABLE PERSONAL SUPPORT

FIELD OF THE INVENTION

The present invention generally relates to sleeping supports. More particularly, the present invention relates to a portable personal support that is used by a person sitting in a chair to rest their head upon.

BACKGROUND OF THE INVENTION

Many times throughout the day a person may want to take a nap or rest. These situations may occur while at work or while traveling in a plane, train, bus or automobile. Unfortunately, when a person wants to rest in these situations there is seldom a bed or appropriate area where the person can lie down. Furthermore, many people cannot rest comfortably while sitting in a chair because the head and neck must be properly supported to facilitate a resting state.

Accordingly, there is a need for a portable device that is a personal support for a person such that they can rest comfortably. The present invention fulfills these needs and provides other related advantages.

SUMMARY OF THE INVENTION

An exemplary embodiment of a portable personal support includes a generally u-shaped base support including a proximal end and a distal end. An intermediate support includes a bottom end and a top end, where the intermediate support is pivotably adjustable and lockable relative to the base support between the proximal end and bottom end. A generally u-shaped head support includes a chin end and a forehead end, where the head support is pivotably adjustable and lockable relative to the intermediate support between the top end and chin end. A generally u-shaped headrest is removably attachable to the head support. In a stored configuration the head support may be disposed within the intermediate support and the intermediate support may be disposed within the base support. Also, the base support, intermediate support and head support may all reside in substantially the same plane. In a deployed configuration the base support and head support are generally horizontally positioned and the intermediate support may be generally vertically positioned.

The base support may be extendable and lockable relative to and between the proximal end and the distal end. The intermediate support may be extendable and lockable relative to and between the bottom end and top end. The headrest may include a padded cushion or an inflatable cushion.

A first arm may be pivotably adjustable and lockable between one end of the first arm to the top end of the intermediate support and pivotably attached between the other end of the first arm to the forehead end of the head support. A second arm may be pivotably attached between one end of the second arm to the chin end of the head support and pivotably and translatably adjustable and lockable between the other end of the second arm to the top end of the intermediate support.

A belt may be attached relative to the base support or intermediate support.

A first locking mechanism may be disposed relative to and between the base support and intermediate support. A second locking mechanism may be disposed relative to and between the intermediate support and the head support. The first and second locking mechanisms may each include a threaded knob oppositely disposed relative to a pivotable cam. The first and second locking mechanisms may each include a geared interface and a threaded axle.

Another exemplary embodiment of a portable personal support includes a base support, an intermediate support pivotably adjustable and lockable relative to the base support, and a head support pivotably adjustable and lockable relative to the intermediate support. In a stored configuration the base support, intermediate support and head support all reside in substantially the same plane. In the stored configuration the head support is disposed within the intermediate support and the intermediate support is disposed within the base support.

A headrest may be removably attachable to the head support, wherein the headrest includes a padded cushion or an inflatable cushion.

Both the base support and intermediate support may be extendable and lockable.

Another exemplary embodiment of a portable personal support includes a base support, an intermediate support pivotably adjustable and lockable relative to the base support, a head support pivotably adjustable and lockable relative to the intermediate support, and a belt receiver attached relative to the base support or intermediate support, such that a belt can be wrapped around a torso of a user to prevent the portable personal support from slipping while in use.

A headrest may be removably attachable to the head support, wherein the headrest includes a padded cushion or an inflatable cushion.

Both the base support and intermediate support are extendable and lockable.

A first locking mechanism may be disposed relative to and between the base support and intermediate support. A second locking mechanism may be disposed relative to and between the intermediate support and the head support.

Another exemplary embodiment of a portable personal support includes a base support including a proximal end and a distal end, an intermediate support including a bottom end and a top end, where the intermediate support is pivotably adjustable and lockable relative to the base support between the proximal end and bottom end, a head support including a chin end and a forehead end, where the head support is pivotably adjustable and lockable relative to the intermediate support between the top end and chin end, a first arm pivotably adjustable and lockable between one end of the first arm to the top end of the intermediate support and pivotably attached between the other end of the first arm to the forehead end of the head support, and a second arm pivotably attached between one end of the second arm to the chin end of the head support and pivotably and translatably adjustable and lockable between the other end of the second arm to the top end of the intermediate support.

In a stored configuration the head support may be disposed within the intermediate support and the intermediate support may be disposed within the base support where the base support, intermediate support and head support all reside in substantially the same plane.

In a deployed configuration the base support and head support may be generally horizontally positioned and the intermediate support may be generally vertically positioned.

A headrest may be removably attachable to the head support, wherein the headrest includes a padded cushion or an inflatable cushion. Both the base support and intermediate supports may be extendable and lockable.

A first locking mechanism may be disposed relative to and between the base support and intermediate support. A second locking mechanism may be disposed relative to and between the intermediate support and the head support.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
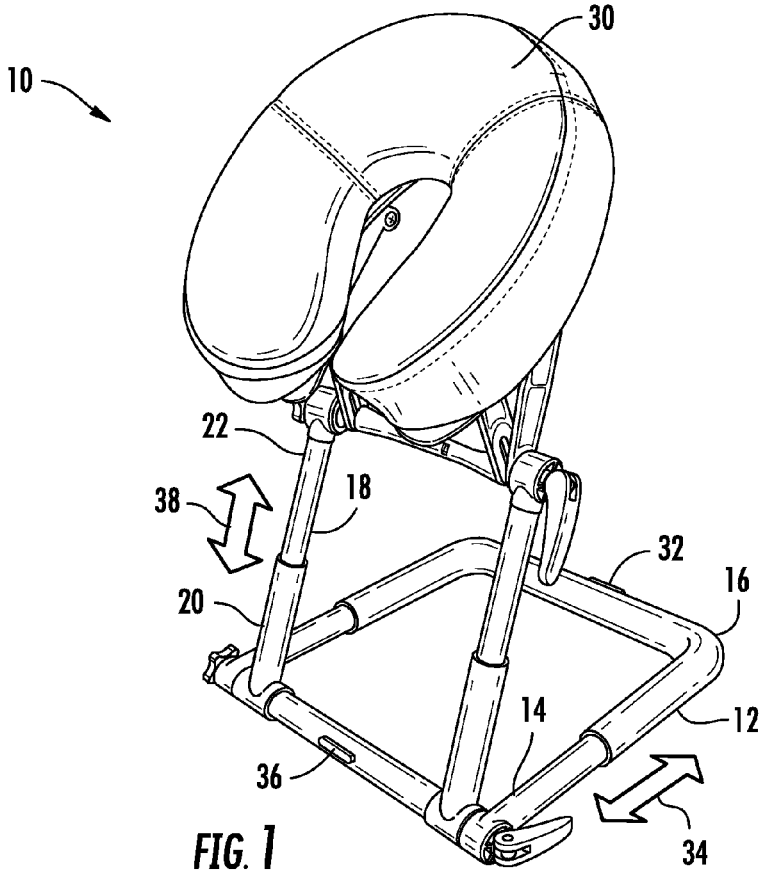
FIG. 1 is a front perspective view of an exemplary portable personal support embodying the present invention.

As shown in the drawings for purposes of illustration, the present invention for a portable personal support is referred to generally by the reference number 10. FIG. 1 is a front perspective view of an exemplary portable personal support 10 embodying the present invention. This exemplary embodiment of a portable personal support 10 includes a generally u-shaped base support 12 including a proximal end 14 and a distal end 16. An intermediate support 18 includes a bottom end 20 and a top end 22, where the intermediate support 18 is pivotably adjustable and lockable relative to the base support between the proximal end 14 and bottom end 20. A generally u-shaped head support 24 includes a chin end 26 and a forehead end 28, where the head support 24 is pivotably adjustable and lockable relative to the intermediate support 18 between the top end 22 and chin end 26. A generally u-shaped headrest 30 is removably attachable to the head support 24.

In a stored configuration the head support 24 may be disposed within the intermediate support 18 and the intermediate support 18 may be disposed within the base support 12. (Best shown in FIG. 3) Also, the base support 12, intermediate support 18 and head support 24 may all reside in substantially the same plane. (Best shown in FIG. 3) In a deployed configuration the base support 12 and head support 24 are generally horizontally positioned and the intermediate support 18 may be generally vertically positioned. (Best shown in FIGS. 7-8)

As shown in FIG. 1, the base support 12 may be extendable and lockable relative to and between the proximal end 14 and the distal end 16 through the use of a first button 32. The movement is depicted with arrow 34. Similarly, the intermediate support 18 may be extendable and lockable relative to and between the bottom end 20 and top end 22 through the use of a second button 36. The movement is depicted with arrow 38.

Figure 2:
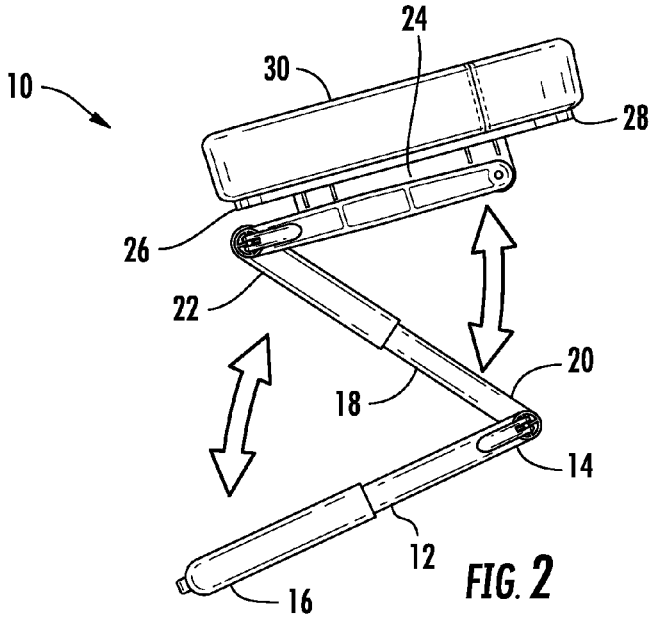
FIG. 2 is a side view of the structure of FIG. 1 showing how the supports pivot between a stored and deployed configuration.
Figure 3:
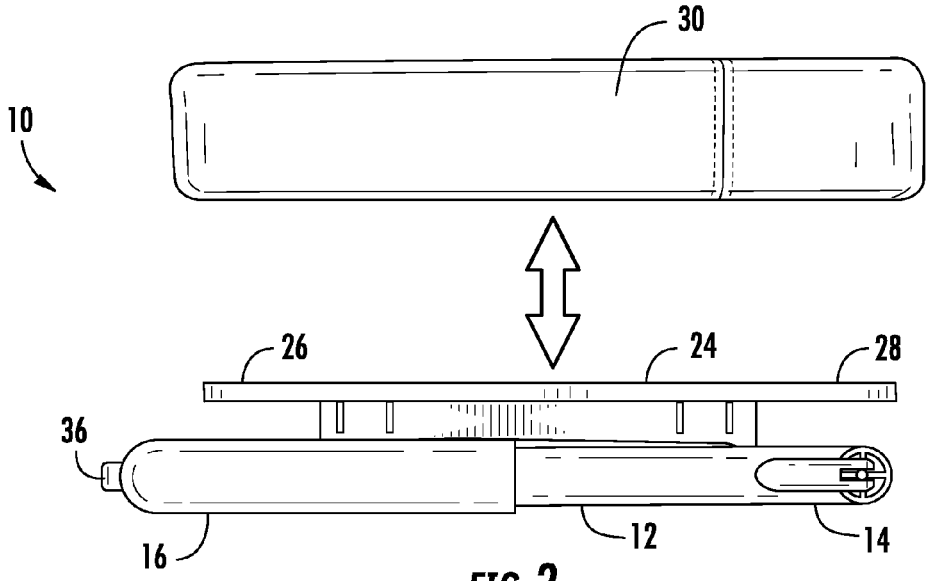
FIG. 3 is a side view of the structure of FIG. 1 in a stored configuration showing the removably attachable headrest.

FIG. 2 is a side view of the portable personal support 10 showing how the supports (12, 18, 24) pivot between a stored and deployed configuration. FIG. 3 is a side view of the portable personal support 10 in a stored configuration showing the removably attachable headrest 30. The headrest 30 may include a padded cushion or an inflatable cushion. An inflatable cushion could be deflated and stored for a smaller overall size, such as for packaging and portability. When the inflatable cushion would be needed, it could simply be inflated at that time through a simple valve mechanism commonly found on inflatable products. FIG. 3 also shows how compact the portable personal support 10 is when in the stored configuration. The supports 12, 18 and 24 are able to next within each other to create this slim profile. It is now significantly easier to store the portable personal support 10 at the office or bring it when traveling. The headrest 30 may also be attached to the head support 24 through the use of buttons, tape, magnets or a hook-and-loop type fastener 40, as best shown in FIG. 4.

Figure 4:
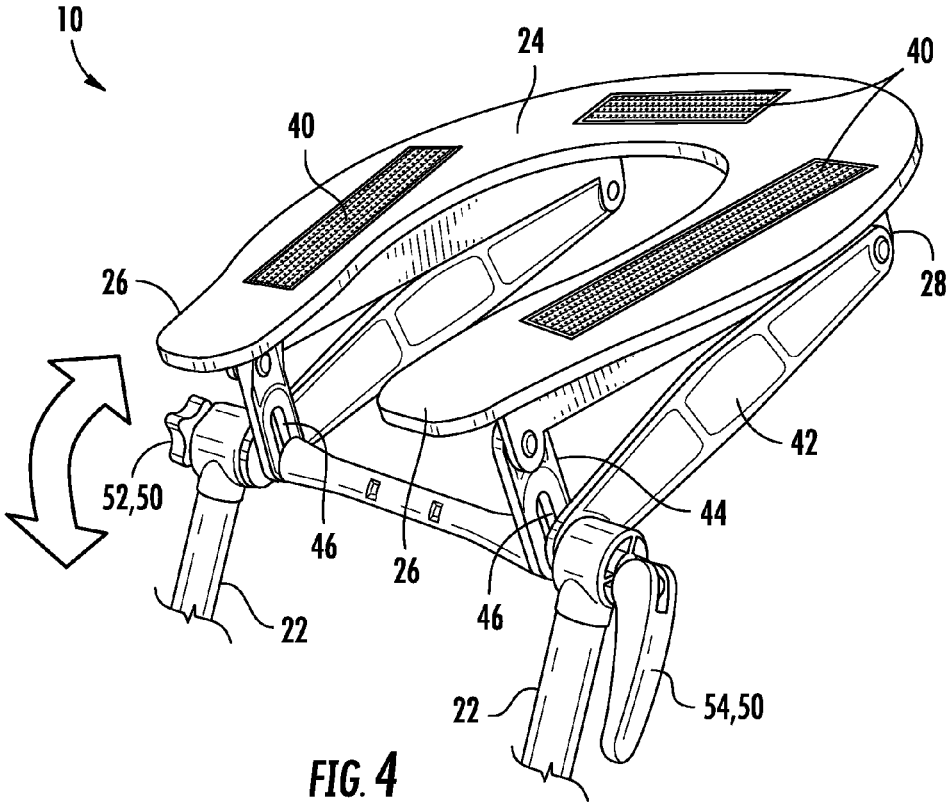
FIG. 4 is an enlarged front perspective view of the structure of FIG. 1 showing the head support with the headrest removed.

FIG. 4 is an enlarged front perspective view of the structure of FIG. 1 showing the head support 24 with the headrest 30 removed. For increased adjustability of the portable personal support 10, a first arm 42 may be pivotably adjustable and lockable between one end of the first arm 42 to the top end 22 of the intermediate support 18 and pivotably attached between the other end of the first arm 42 to the forehead end 28 of the head support 24. A second arm 44 may be pivotably attached between one end of the second arm 44 to the chin end 26 of the head support 24 and pivotably and translatably adjustable and lockable between the other end of the second arm 44 to the top end 22 of the intermediate support 18. Translation and the pivot is obtainable through the use of the slot 46.

Figure 5:
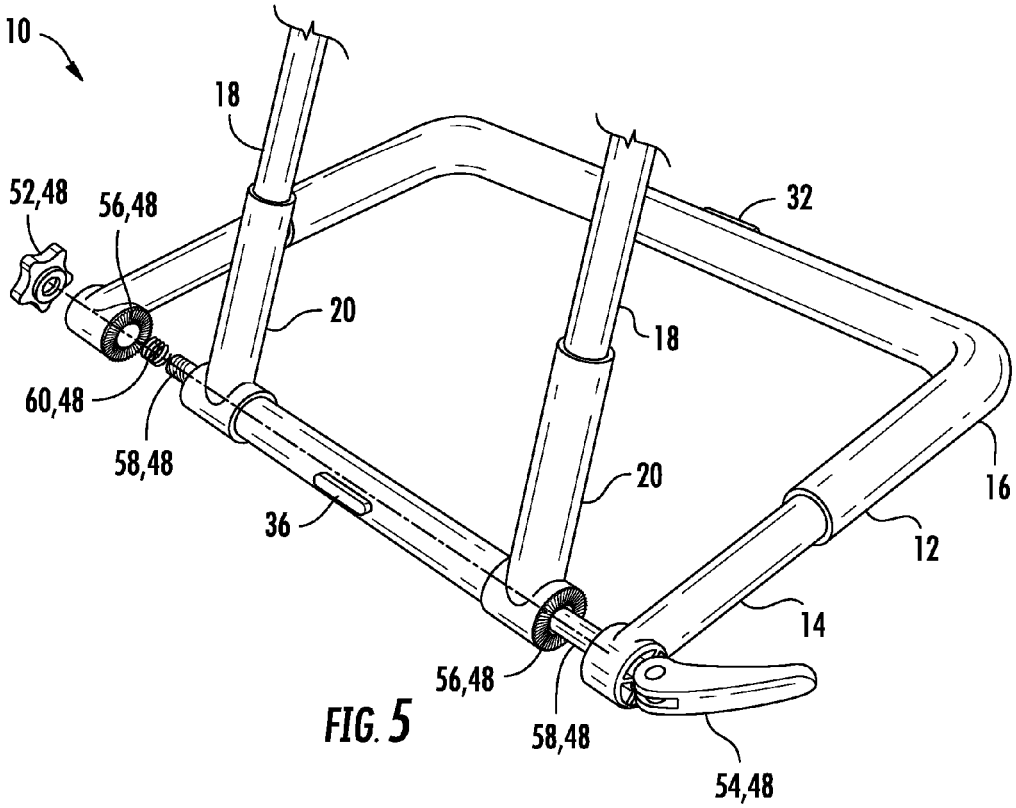
FIG. 5 is an enlarged exploded front perspective view of the structure of FIG. 1 showing the base support and its associated parts.
Figure 6:
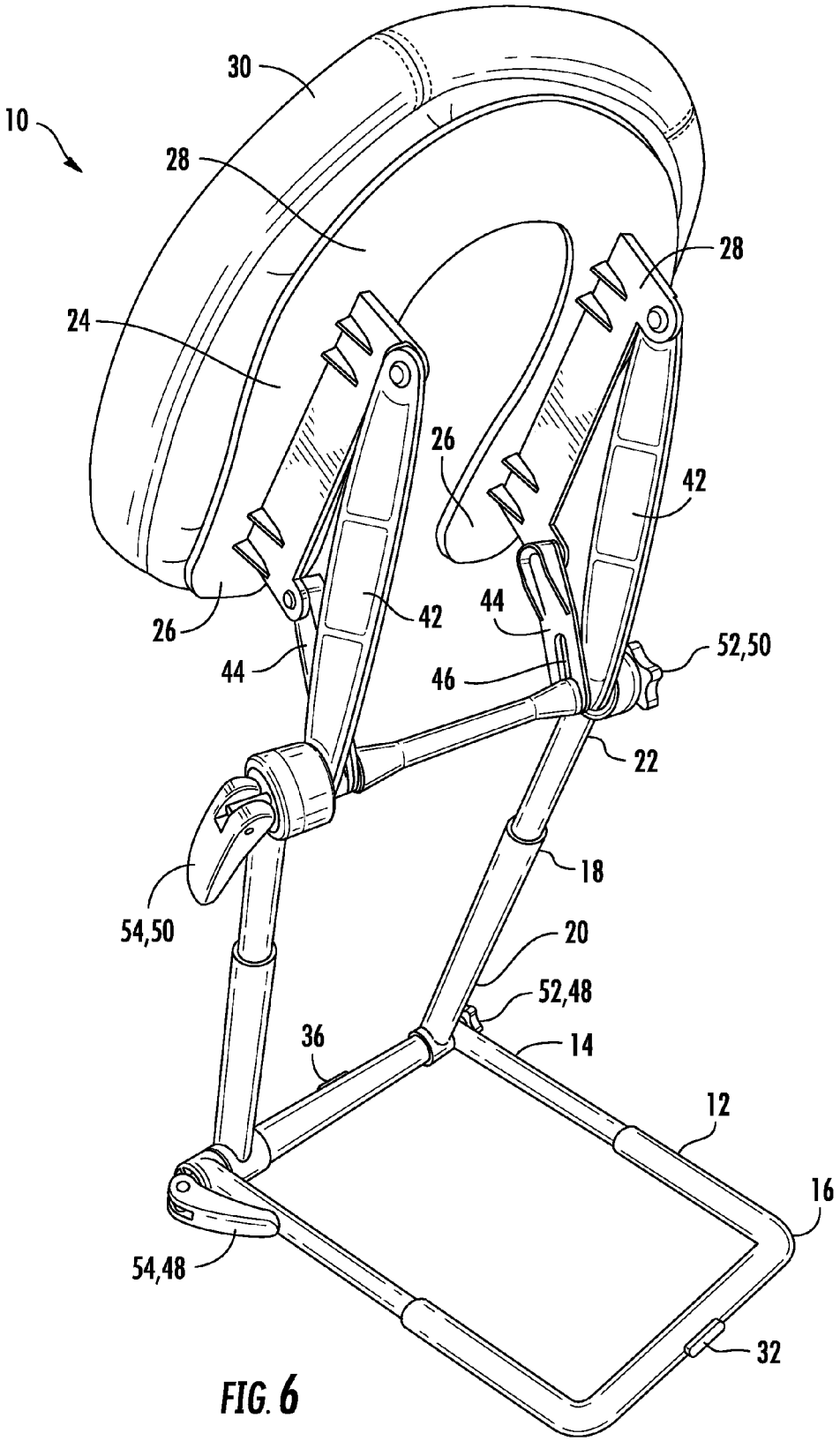
FIG. 6 is rear perspective view of the structure of FIG. 1.

FIG. 5 is an enlarged exploded front perspective view of the portable personal support 10 showing the base support 12 and its associated parts. A first locking mechanism 48 may be disposed relative to and between the base support 12 and intermediate support 18. A second locking mechanism 50 may be disposed relative to and between the intermediate support 18 and the head support 24. The first 48 and second locking mechanisms 50 may each include a threaded knob 52 oppositely disposed relative to a pivotable cam 54. The threaded knob 52 is rotated until an appropriate amount of looseness in the mechanism is removed. Then the pivotable cam 54 is pivoted further tightening and locking the mechanisms into place. The first 48 and second locking mechanisms 50 may each include a geared interface 56 and a threaded axle 58. The geared interface 56 creates an engagement within the mechanisms that locks into position when tightened. The threaded knob 52 engages the threads of the threaded axle 58. The exact gearing can include a multitude of teeth shapes commonly used by those skilled in the art. A spring 60 can also be included to create a preload when the knob 52 is rotated between positions.

Figure 7:
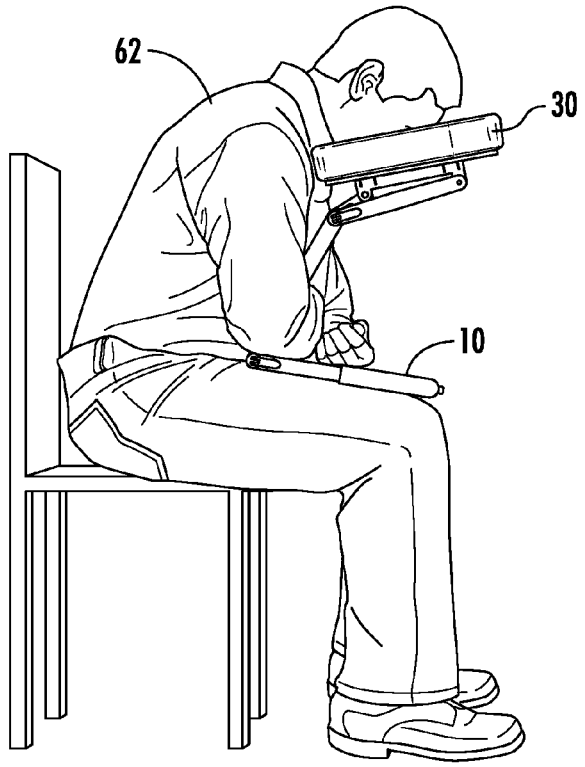
FIG. 7 is a side view of the structure of FIG. 1 being used by a person while sitting to rest their torso and head.

FIG. 7 is a side view of the structure of FIG. 1 being used by a person 62 while sitting to rest their torso and head. The person 62 has placed the portable personal support 10 upon their lap and leans forward. Alternatively, the support 10 could be placed upon a desk and then rested upon. As can be seen, the support 10 can used while at home, in the office or traveling within a plane, train or automobile.

Figure 8:
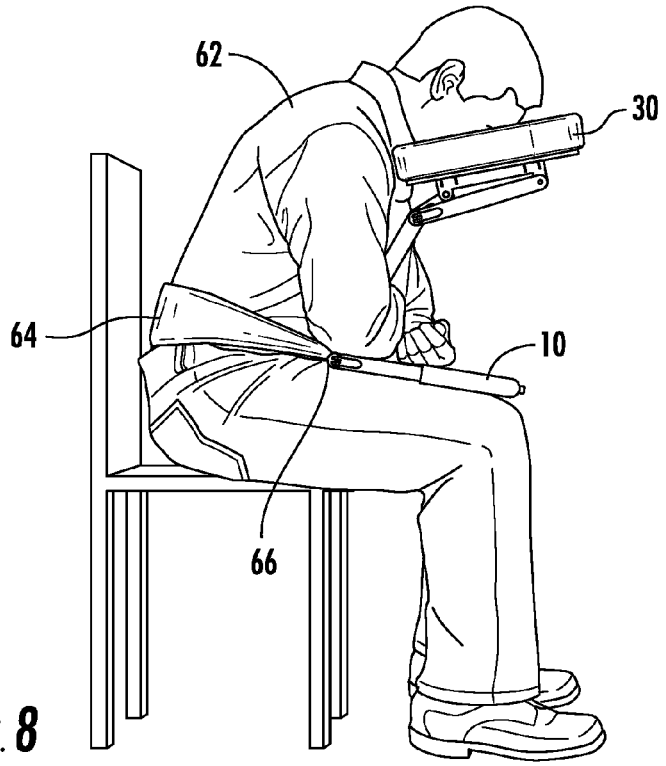
FIG. 8 is a side view of the structure of FIG. 1 being used by a person while sitting to rest their torso and head now including a belt for additional support.

FIG. 8 is similar to FIG. 7, but now shows a belt 64 attached around the torso of the person 62 and connected to the support 10 at belt receiver locations 66. The belt 64 prevents the support 10 from slipping forward when in use by the person 62. The belt 64 may be attached relative to the base support 12 or intermediate support 18.

Figure 9:
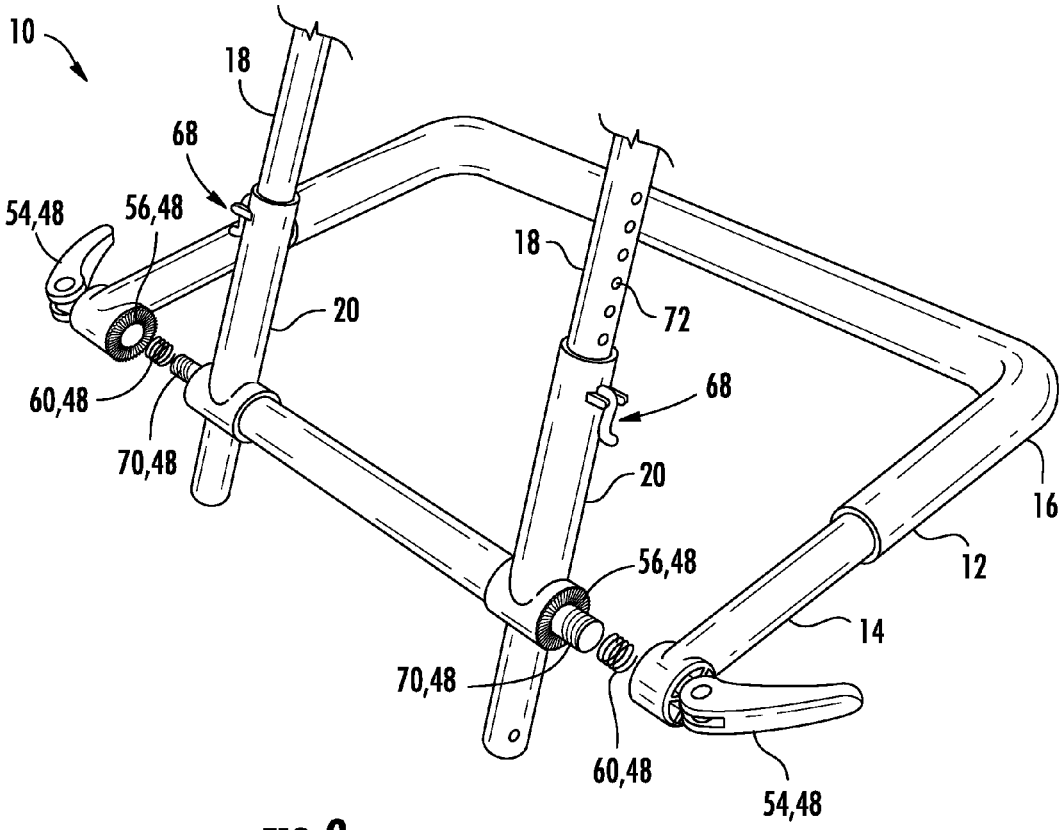
FIG. 9 is an enlarged exploded front perspective view similar to FIG. 5, now showing a new embodiment of the present invention.
Figure 10:
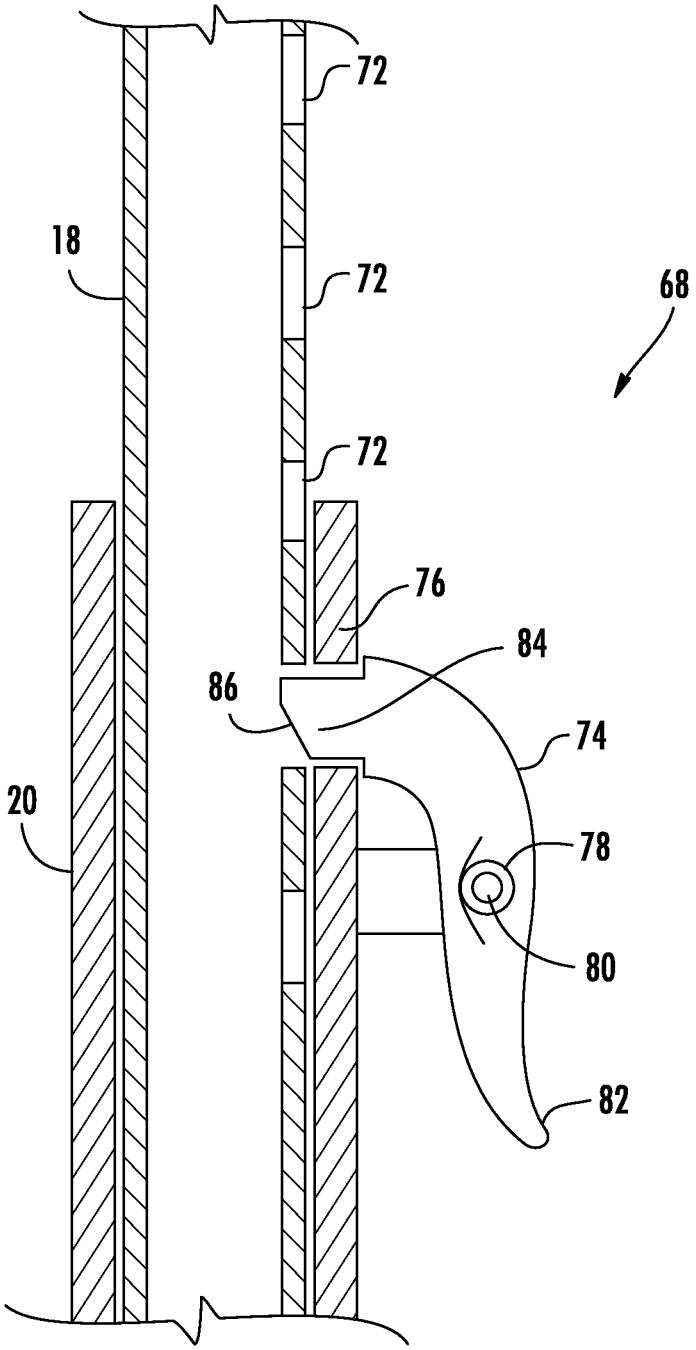
FIG. 10 is an enlarged sectional view of an embodiment of a release mechanism of the structure of FIG. 9.

FIG. 9 is an enlarged exploded front perspective view similar to FIG. 5, now showing a new embodiment of the portable personal support 10. FIG. 10 is an enlarged sectional view of an embodiment of a release mechanism 68 of the structure of FIG. 9. In these embodiments, the threaded axle 58 of FIG. 5 is replaced with two threaded studs 70. The threaded studs 70 are permanently attached to the bottom end 20. The threaded studs 70 may be molded in place when the intermediate support 18 is formed, or bonded or fastened in any suitable method known by one skilled in the art. The threaded studs 70 do not connect from one side to the other. This allows the intermediate support 18 to slide through the bottom end 20 when a person is adjusting the portable personal support 10. The intermediate support 18 can be seen exiting through the bottom of the bottom end 20. In this embodiment as shown two pivotable cams 54 are used to lock the geared interfaces 56 in place. Alternatively, two threaded knobs 52 could be used as well.

To control the height of the intermediate support 18 relative to the bottom end 20, one embodiment of a release mechanism 68 is shown. The release mechanism 68 is best depicted in FIG. 10. A plurality of holes 72 are disposed along the length of the intermediate support 18. A pivotable lock 74 is pivotably attached to the bottom end 20 at a pivot 80. The pivotable lock 74 may be biased in the locked position as is shown in FIG. 10 through a spring or other biasing means 78. The lock 74 is shaped to fit through the plurality of holes 72 and through a hole 76 in the bottom end 20. The lock 74 engages the holes 72 and the hole 76 to prevent downward movement. A person can then press the proximal end 82 to release the distal end 84.

The distal end 84 may be formed, as shown here, to allow upward movement of the intermediate support 18 while preventing downward movement of the intermediate support 18. This is accomplished through the angled surface 86. In an alternative embodiment not shown, the distal end 84 may be formed to prevent both upward and downward movement of intermediate support 18 unless a person presses the proximal end 82 thereby releasing the distal end 84 from the holes 72, 76.

Although several embodiments have been described in detail for purposes of illustration, various modifications may be made to each without departing from the scope and spirit of the invention. Accordingly, the invention is not to be limited, except as by the appended claims.

What is claimed is:

1. A portable personal support, comprising:

a generally u-shaped base support comprising a proximal end and a distal end;

an intermediate support comprising a bottom end and a top end, where the bottom end of the intermediate support is pivotably adjustable, lockable, and directly attached to the proximal end of the base support;

a generally u-shaped head support comprising a chin end and a forehead end, where the chin end of the head support is pivotably adjustable, lockable, and attached to the top end of the intermediate support; and a generally u-shaped headrest removably attachable to the head support;

wherein in a stored configuration the head support is disposed within the intermediate support and the intermediate support is disposed within the base support, where the forehead end of the head support is adjacent to the proximal end of the base support, where the chin end of the head support is adjacent to the distal end of the base support, and also where the base support, intermediate support and head support all reside in substantially the same plane;

wherein when transitioning from the stored configuration to a deployed configuration the base support pivots at least 180 degrees with respect to the intermediate support; and including a first arm pivotably adjustable, lockable, and directly attached at one end of the first arm to the top end of the intermediate support and pivotably and directly attached at the other end of the first arm to the forehead end of the head support, and including a second arm pivotably and directly attached at one end of the second arm to the chin end of the head support and pivotably and translatably adjustable, lockable, and directly attached at the other end of the second arm to the top end of the intermediate support, the length of the first arm being greater than the length of the second arm.

2. The portable personal support of claim 1, wherein in the deployed configuration the base support and head support are generally horizontally positioned and the intermediate support is generally vertically positioned.

3. The portable personal support of claim 1, wherein the base support is extendable and lockable relative to and between the proximal end and the distal end.

4. The portable personal support of claim 1, wherein the intermediate support is extendable and lockable relative to and between the bottom end and top end.

5. The portable personal support of claim 1, wherein the headrest comprises a padded cushion or an inflatable cushion.

6. The portable personal support of claim 1, including a belt attached relative to the base support or intermediate support.

7. The portable personal support of claim 1, including a first locking mechanism relative to and between the base support and intermediate support.

8. The portable personal support of claim 7, including a second locking mechanism relative to and between the intermediate support and the head support.

9. The portable personal support of claim 8, wherein the first and second locking mechanisms each comprise a threaded knob oppositely disposed relative to a pivotable cam.

10. The portable personal support of claim 9, wherein the first and second locking mechanisms each comprise a geared interface and a threaded axle.

11. A portable personal support, comprising:

a generally u-shaped base support comprising a proximal end and a distal end;

an intermediate support comprising a bottom end and a top end, where the bottom end of the intermediate support is pivotably adjustable, lockable, and directly attached to the proximal end of the base support;

a head support comprising a chin end and a forehead end, when the chin end of the head support is pivotably adjustable and lockable at the top end of the intermediate support;

a first arm pivotably adjustable, lockable, and directly attached at one end of the first arm to the top end of the intermediate support and pivotably and directly attached at the other end of the first arm to the forehead end of the head support;

a second arm pivotably and directly attached at one end of the second arm to the chin end of the head support and pivotably and translatably adjustable, lockable, and directly attached at the other end of the second arm to the top end of the intermediate support, the length of the first arm being greater than the length of the second arm;

wherein in a stored configuration the head support is disposed within the intermediate support and the intermediate support is disposed within the base support and also where the base support, intermediate support, and head support all reside in substantially the same plane; and wherein when transitioning from the stored configuration to a deployed configuration the base support pivots at least 180 degrees with respect to the intermediate support.

12. The portable personal support of claim 11, wherein in a deployed configuration the base support and head support are generally horizontally positioned and the intermediate support is generally vertically positioned.

13. The portable personal support of claim 12, including a headrest removably attachable to the head support, wherein the headrest comprises a padded cushion or an inflatable cushion.

14. The portable personal support of claim 13, wherein both the base support and intermediate support are extendable and lockable.

15. The portable personal support of claim 14, including a first locking mechanism relative to and between the base support and intermediate support and including a second locking mechanism relative to and between the intermediate support and the head support.

* * * * *